US006217417B1

(12) United States Patent
Nakamura et al.

(10) Patent No.: US 6,217,417 B1
(45) Date of Patent: Apr. 17, 2001

(54) METHOD FOR POLISHING THIN PLATE AND PLATE FOR HOLDING THIN PLATE

(75) Inventors: Mikio Nakamura; Takahiro Kida, both of Kosyoku (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/267,661

(22) Filed: Mar. 15, 1999

(30) Foreign Application Priority Data

Mar. 30, 1998 (JP) ..... 10-084249

(51) Int. Cl.[7] ..... B24B 7/22
(52) U.S. Cl. ..... 451/41; 451/398
(58) Field of Search ..... 451/41, 288, 287, 451/398, 388

(56) References Cited

U.S. PATENT DOCUMENTS 4,256,535 3/1981 Banks .
4,693,036 9/1987 Mori .
5,934,981 * 8/1999 Tanaka et al. ..... 451/41
5,938,512 * 8/1999 Takei et al. ..... 451/388

FOREIGN PATENT DOCUMENTS 0 776 730 A1 6/1997 (EP) .
1 258 676 12/1971 (GB) .

* cited by examiner

*Primary Examiner*—Robert A. Rose
(74) *Attorney, Agent, or Firm*—Oliff & Berridge, PLC

(57) ABSTRACT

A method for polishing a thin plate including holding the thin plate on a front surface of a holding plate, and moving the thin plate and a polishing pad relative to each other while pressing the thin plate against the polishing pad and supplying a polishing slurry between them. The holding plate is composed of ceramic. The front surface of the holding plate has been previously polished.

14 Claims, 1 Drawing Sheet

METHOD FOR POLISHING THIN PLATE AND PLATE FOR HOLDING THIN PLATE

BACKGROUND OF THE INVENTION

1. Field of the Invention

The present invention relates to a method for polishing a thin plate, for example, a semiconductor wafer, a wafer made of quartz, ceramic material or the like, and to a holding plate for holding the thin plate, which is used during polishing.

2. Description of Related Art

Conventionally, polishing for a thin plate is carried out by giving a relative motion between the thin plate to be polished and a polishing cloth, i.e., polishing pad, while holding the thin plate on a holding plate and pressing the thin plate against the polishing pad by loading the holding plate from a polishing head, with supplying a polishing slurry between the thin plate and the polishing pad.

As the holding plate for holding a thin plate, one made of glass or ceramic Is generally used. However, one made of glass is relatively easy to bend when it is loaded from the polishing head. Because of the effect of bending, the peripheral portion of the thin plate tends to be pressed more strongly against the polishing pad, so that the peripheral portion may be polished more than the central portion thereof. As a result, there is a problem that the flatness of the polished surface of the thin plate is inferior to that of a ceramic plate because of non-uniform polishing in the surface of the thin plate. Therefore, when a high flatness is required, a ceramic plate is generally used as the holding plate.

Although the ceramic holding plate is manufactured through steps of forming and sintering, it is difficult to obtain a ceramic holding plate with precise dimensions for front and back surfaces by only such steps. Generally, in order to obtain precise dimensions therefor, a mechanical processing is performed on the peripheral, front and back surfaces of the plate after the forming and sintering. As the mechanical processing, lapping using a bonded diamond grinding wheel is performed. During lapping, a predetermined abrasive slurry is supplied, and after the lapping, an acid cleaning using an acid aqueous solution containing hydrochloric acid or the like, and a pure water cleaning are carried out for washing the abrasive slurry away.

When a polishing has been carried out with a ceramic holding plate which was made in the above-described manner, it has been ascertained that the following problem often occurs.

That is, when a polishing is carried out to thin plates by using a ceramic holding plate, in batch processing, it has been ascertained that there is a high probability that scratches due to polishing and the like are formed in the polished surfaces of all thin plates and that scratches, dents or stains are formed on the back surfaces of the thin plates. Because the existence of such scratches, dents or the like lead to an extreme drop of the rate of acceptable products, an urgent countermeasure thereto is desired.

SUMMARY OF THE INVENTION

The present Invention was developed In view of these problems.

An object of the present invention is to provide a polishing method which is effective for improvement in throughput of the thin plates.

Another object of the present invention is to provide a holding plate for holding a thin plate thereon, which is effective for improvement in throughput of the thin plates.

The inventors of the present invention conducted a variety of experiments to research the cause of lowering in throughput of the thin plates. As a result, the following has been found.

First, the scratches on the front surface of the thin plate due to polishing and the scratches, dents or stains on the back surface are caused by the abrasive grains from the bonded diamond wheel and the ceramic dusts. Second, the scratches due to polishing are mainly caused by the abrasive grains from the bonded diamond wheel and the ceramic dusts, which are attached to the back surface of a holding plate for holding the thin plate. Third, the scratches or stains on the back surface of the thin plate are caused by the abrasive grains from the bonded diamond wheel and the ceramic dusts, which are attached to the front surface of the holding plate.

That is, during lapping the holding plate by a bonded diamond wheel, abrasive grains are separated down from the bonded diamond wheel to attach to the front and back surfaces of the holding plate. The attached abrasive grains on the front and back surfaces of the holding plate are hard to separate therefrom even by the following acid cleaning and pure water cleaning. As a result, after the following steps of acid cleaning and pure water cleaning, a lot of attached abrasive grains are left thereon. On the surface of the lapped holding plate, there are fine irregularities. The fine irregularities contribute to creation of dusts. When the abrasive grains or ceramic dusts on the holding plate are separated to fall on the polishing pad before or during polishing, the surface to be polished, of the thin plate is scratched by the fallen abrasive grains or ceramic dusts during the polishing step. When abrasive grains are left on the front surface of the holding plate or ceramic dusts are attached thereto, and a thin plate is adhered to the holding plate through wax, in the region in which the abrasive grains or the dusts are left, scratches are created on the back surface of the thin film or stains are induced on the back surface, during the polishing step.

The present invention was made on the basis of the above-described knowledge.

In accordance with one aspect of the present invention, the method for polishing a thin plate comprises the steps of: holding the thin plate on a front surface of a holding plate, wherein the holding plate is made of ceramic and the front surface thereof to hold the thin plate thereon has been polished; and carrying out a relative motion between the thin plate and a polishing pad while pressing the thin plate against the polishing pad with supplying a polishing slurry between them. The material for the holding plate can be selected from various types of ceramic, e.g., alumina, silicon carbide, silicon nitride, and the like.

According to the method for polishing a thin plate, the previous polishing for the front surface of the holding plate can clear the abrasive grains separated from the bonded diamond wheel and the ceramic dusts, away from the front surface of the holding plate and can make the front surface of the holding plate smooth. Accordingly, because polishing for the thin plate is carried out without abrasive grains from the bonded diamond wheel nor ceramic dusts, on the front surface of the holding plate, it is possible to effectively prevent the occurrence of scratches due to polishing on the front surface of the thin plate, caused by the abrasive grains and ceramic dusts separated from the front surface of the holding plate, and the occurrence of scratches or stains on the back surface of the thin plate, caused by the abrasive grains and the dusts which are attached to the front surface of the holding plate.

Preferably, the holding plate further has a back surface which has been polished.

According to the method for polishing a thin plate, the previous polishing for the back surface of the holding plate can clear the abrasive grains separated from the bonded diamond wheel and the ceramic dusts, away from the back surface of the holding plate and can make the back surface of the holding plate smooth. Accordingly, because polishing for the thin plate is carried out without abrasive grains from the bonded diamond wheel nor ceramic dusts, on the back surface of the holding plate, it is possible to effectively prevent the occurrence of scratches due to polishing on the front surface of the thin plate, caused by the abrasive grains and dusts separated from the back surface of the holding plate.

Preferably, the holding plate further has a peripheral surface which has been polished.

According to the method for polishing a thin plate, the previous polishing for the back surface of the holding plate can clear the abrasive grains separated from the bonded diamond wheel and the ceramic dusts, away from the peripheral surface of the holding plate and can make the peripheral surface of the holding plate smooth. Accordingly, because polishing for the thin plate is carried out without abrasive grains from the bonded diamond wheel or ceramic dusts from the thin plate, on the peripheral surface of the holding plate, it is possible to effectively prevent the occurrence of scratches due to polishing on the front surface of the thin plate, caused by the abrasive grains and dusts separated from the peripheral surface of the holding plate.

The thin plate may be held on the holding plate by a wax mounting method. The thin plate may be one selected from the group consisting of a silicon wafer, quartz wafer, and ceramic material.

Preferably, polishing for the holding plate is carried out by using the same type of polishing pad as one which was used for polishing the thin plate. It is further preferable that the polishing for the holding plate is carried out by using the same type of polishing slurry as one which was used for polishing the thin plate. Such a use of a polishing pad or polishing slurry can prevent lowering of the surface accuracy of the polished thin plate caused by being held on an inferior surface of the holding plate.

Preferably, the polishing for the holding plate comprises a first stage of rough polishing, a second stage of intermediate polishing and a third stage of finish polishing. The thin plate may be one selected from the group consisting of a silicon wafer, quartz wafer, and ceramic wafer.

In accordance with another aspect of the present invention, the holding plate is made of ceramic and a front surface thereof to hold the thin plate thereon has been polished.

According to the holding plate for holding a thin plate, because of having the polished front surface, no abrasive grains from the bonded diamond wheel nor ceramic dusts are attached on the front surface of the holding plate. Further, the front surface of the holding plate is smooth. Accordingly, because polishing for the thin plate is carried out without abrasive grains from the bonded diamond wheel nor ceramic dusts, on the front surface of the holding plate, it is possible to effectively prevent the occurrence of scratches due to polishing on the front surface of the thin plate, caused by the abrasive grains and ceramic dusts separated from the front surface of the holding plate, and the occurrence of scratches or stains on the back surface of the thin plate, caused by the abrasive grains and the dusts which are attached to the front surface of the holding plate.

Preferably, the holding plate further has a back surface which has been polished.

According to the holding plate for holding a thin plate, because the back surface of the holding plate is polished, no abrasive grains from the bonded diamond wheel nor ceramic dusts are attached on the back surface of the holding plate. Further, the back surface of the holding plate is smooth. Accordingly, because polishing for the thin plate is carried out without abrasive grains from the bonded diamond wheel nor ceramic dusts, on the back surface of the holding plate, it is possible to effectively prevent the occurrence of scratches due to polishing on the front surface of the thin plate, caused by the abrasive grains and ceramic dusts separated from the back surface of the holding plate.

Preferably, the holding plate further has a peripheral surface which has been polished.

According to the holding plate for holding a thin plate, because the peripheral surface of the holding plate is polished, no abrasive grains from the bonded diamond wheel nor ceramic dusts are attached on the peripheral surface of the holding plate. Further, the front surface of the holding plate is smooth. Accordingly, because polishing for the thin plate is carried out without abrasive grains from the bonded diamond wheel nor ceramic dusts from the thin plate, on the peripheral surface of the holding plate, it is possible to effectively prevent the occurrence of scratches due to polishing on the front surface of the thin plate, caused by the abrasive grains and ceramic dusts separated from the peripheral surface of the holding plate.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENTS OF THE INVENTION

Figure 1:
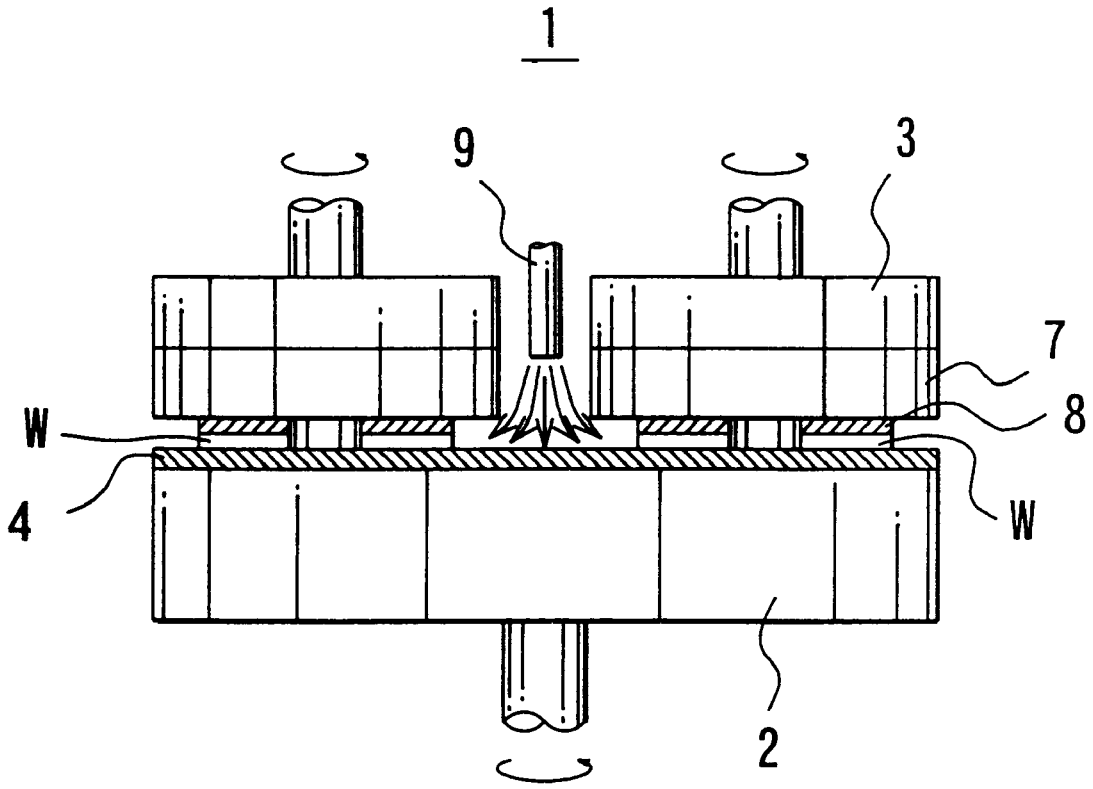
FIG. 1 is a view showing a polishing apparatus for carrying out the polishing method according to the present invention.

An example of the polishing apparatus for carrying out the polishing method of the present invention is shown in FIG. 1. The polishing apparatus 1 is provided with a turn table 2 and polishing heads 3.

On the upper surface of the turn table 2, a polishing pad 4 made of, e.g., a non-woven bonded fabric for polishing or the like is adhered. The turn table 2 is connected with a turn table driving motor which is not shown, to be rotated thereby. Each polishing head 3 is organized to be rotatable, and to be movable up and down by a cylinder device which is connected with the polishing head 3, though it is not shown in the figure.

On the lower surface of the polishing head 3, a wafer holding plate 7 for holding wafers on the lower surface thereof is provided. The wafer holding plate 7 is made of ceramic, e.g., alumina, silicon carbide, silicon nitride, and the like. A polishing processing is previously carried out on the front (lower), back and peripheral surfaces of the holding plate 7. For the polishing processing of the wafer holding plate 7, although it is not limited, the same type of polishing pad as the one to be used for polishing a silicon wafer, is preferably used. The same type of polishing slurry, as the one to be used for polishing a silicon wafer, is used, for example, colloidal silica or the like dispersed in an aqueous alkali solution such as potassium hydroxide (KOH) or sodium hydroxide (NaOH). Thus, after the front, back and peripheral surfaces of each holding plate 7 are polished, a plurality of silicon wafers (thin plates) W are adhered and held at predetermined positions on the front surface of the holding plate 7 through a wax 8.

Above the central portion of the turn table 2, a nozzle for supplying polishing slurry to the rubbed portion of the silicon wafer W and the polishing pad 4 is arranged.

Next, an example of a manner of polishing the silicon wafer W will be explained.

First, a wafer holding plate 7 is set on the upper surface of the turn table 2 at a position under each polishing head 3, in a state of the polishing head 3 ascended by a cylinder device. Thereafter, the turn table 2 is rotated. Then, the wafer holding plate 7 set on the turn table 2 rotates on its axis according to the rotation of the turn table 2. Thus, the silicon wafer W is rubbed and polished with the polishing pad 4. During polishing, polishing slurry is supplied to the rubbed portion of the silicon wafer W and the polishing pad 4, from the nozzle 9.

When polishing for the silicon wafer W is carried out by such a method, the following effects are obtained.

That is, according to the polishing method, because of using the wafer holding plate 7 which has the front and back surfaces for holding the silicon wafer W thereon and the peripheral surface, which were previously polished, no abrasive grains from the bonded diamond wheel and no ceramic dusts are attached to the front surface of the wafer holding plate 7. Accordingly, it is possible to prevent the back surface of the silicon wafer W from formation of scratches and attachment of stain. Further, because no abrasive grains from the bonded diamond wheel and no ceramic dusts drop on the polishing pad 4 from the back and peripheral surfaces of the wafer holding plate 7. it is possible to suppress generation of scratches on the front surface of the silicon wafer W.

Thirty thousand polished silicon wafers were prepared by each of the polishing methods according to the present invention and the above-described prior art in which the holding plates have not been polished, to examine the number of wafers having a scratch which can be found by visual inspection under a collimated light by a condensing lamp, on the front surface thereof due to polishing, for each silicon wafer which was polished by each method. As a result, it was ascertained that the occurrence ratio of the number of wafers having a scratch, according to the prior art was 1.00%. On the contrary, that of the polishing method according to the present invention was 0.20%, that is, it was reduced to about ⅕.

Thirty thousand polished silicon wafers were prepared by each of the polishing methods according to the present invention and the above-described prior art, to examine the number of foreign substances having a size not smaller than 3.0 m existing on the back surface of each silicon wafer which was polished by each method. As a result, it was ascertained that the average number of foreign substances on the back surface of a wafer, according to the prior art was about 100. On the contrary, that of the polishing method according to the invention was about 10, that is, it was reduced to about 1/10.

In the above-described two experiments, as the ceramic material for the wafer holding plate, alumina was used; and to the holding plate, three staged polishing which was generally carried out in a polishing for an ordinary silicon wafer, were carried out. The first stage thereof is a rough polishing for mirror-polishing the etched wafer by removing the waviness thereof, so that the entire polishing stock removal is large. The third stage thereof is a finish polishing for improving the minute surface roughness of the wafer, so that the entire polishing stock removal is small. The second stage thereof is an intermediate stage of polishing which has an intermediate purpose between the first and third stages. Thereafter an ultrasonic wave cleaning was carried out by using pure water or an alkaline solution.

Although the present invention has been explained according to the embodiments, it should also be understood that the present invention is not limited to the embodiments and that various changes and modifications may be made to the invention without departing from the gist thereof.

For example, in the above-described embodiments, although only a batch processing type of polishing method has been explained, it is a matter of course that the present invention can be applied for a single wafer processing type of polishing method. In the above-described embodiments, although only the case of a silicon wafer held on the wafer holding plate by the wax-mounting method has been explained, the present invention can be also applied to the case of a waxless polishing. In the case of a waxless polishing, a porous backing pad is adhered on the front surface of the holding plate and a template blank which has a hole(s) for accommodating the thin plate(s) is adhered on the surface of the backing pad. Polishing of the thin plate(s) is carried out by accommodating the thin plate(s) in a hole(s) of thus fabricated holding plate.

In the above-described embodiments, although only a polishing method for a silicon (semiconductor) wafer has been explained, it is a matter of course that the present invention can be also applied for other wafers composed of, e.g., quartz, ceramic material, and the like.

What is claimed is:

1. A method for polishing a thin plate, comprising:

providing a holding plate composed of ceramic, the holding plate including a front surface composed of a ceramic and which has been polished and a back surface which has been polished;

holding the thin plate on the front surface of the holding plate; and moving the thin plate and a polishing pad relative to each other while pressing the thin plate against the polishing pad and supplying a polishing slurry between the thin plate and the polishing pad.

2. The method for polishing a thin plate according to claim 1, wherein the holding plate includes a peripheral surface which has been polished.

3. The method for polishing a thin plate according to claim 1, wherein the thin plate is held on the holding plate by a wax.

4. The method for polishing a thin plate according to claim 1, wherein the holding plate is polished using the same type of polishing pad as a polishing pad that was used for polishing the thin plate.

5. The method for polishing a thin plate according to claim 1, wherein the holding plate is polished using the same type of polishing slurry as a polishing slurry that was used for polishing the thin plate.

6. The method for polishing a thin plate according to claim 1, wherein the holding plate is polished by a process including a first stage of rough polishing, a second stage of intermediate polishing and a third stage of finish polishing.

7. The method for polishing a thin plate according to claim 1, wherein the thin plate is selected from the group consisting of a silicon wafer, a quartz wafer, and a ceramic wafer.

8. A holding plate for holding a thin plate to press the thin plate against a polishing pad for polishing the thin plate, wherein the holding plate is composed of ceramic and includes a front surface to hold the thin plate and a back surface, the front surface is composed of ceramic and has been polished and the back surface has been polished.

9. The holding plate for holding a thin plate according to claim 5, wherein the holding plate includes a peripheral surface which has been polished.

10. The method for polishing a thin plate according to claim 2, wherein the back surface and the peripheral surface are composed of ceramic.

11. The method for polishing a thin plate according to claim 2, wherein the peripheral surface is composed of ceramic.

12. The method for polishing a thin plate according to claim 1, wherein the back surface is composed of ceramic.

13. A holding plate for holding a thin plate to press the thin plate against a polishing pad for polishing the thin plate, wherein the holding plate consists essentially of ceramic and includes a front sufface to hold the thin plate and a back surface, and the front surface and the back surface have been polished.

14. The holding plate for holding a thin plate according to claim 13, wherein the holding plate includes a peripheral surface which has been polished.

* * * * *